United States Patent [19]

Henych et al.

[11] 4,062,398

[45] Dec. 13, 1977

[54] AUXILIARY DEVICE FOR USE WITH A PERMANENT MOLD IN CASTING OPERATIONS

[75] Inventors: Ivo Henych; Erwin Fischer; Jürg Reist, all of Schaffhausen, Switzerland

[73] Assignee: Georg Fischer Aktiengesellschaft, Schaffhausen, Switzerland

[21] Appl. No.: 698,901

[22] Filed: June 23, 1976

[30] Foreign Application Priority Data

June 27, 1975 Switzerland ..... 8371/75

[51] Int. Cl.[2] ..... B22D 7/12; B22D 35/04

[52] U.S. Cl. ..... 164/337; 249/105; 249/108; 249/204

[58] Field of Search ..... 249/105, 106, 108, 197, 249/204; 164/337

[56] References Cited

U.S. PATENT DOCUMENTS

| | | | |
|---|---|---|---|
| 2,482,352 | 9/1949 | Litton | 249/105 |
| 3,409,267 | 11/1968 | Wszolek | 249/105 |

FOREIGN PATENT DOCUMENTS

| | | | |
|---|---|---|---|
| 767,257 | 4/1952 | Germany | 249/204 |

*Primary Examiner*—Robert D. Baldwin

*Attorney, Agent, or Firm*—Toren, McGeady and Stanger

[57] ABSTRACT

An auxiliary device for use with a permanent mold in casting operations includes a cover plate having an upwardly and a downwardly facing surface. In place on the permanent mold, the downwardly facing surface defines the upper limit of the mold cavity. At least one pipe extends through an opening in the cover plate with its lower end in the plane of the downwardly facing surface of the cover plate. An annular recess located in one of the downwardly facing surface of the cover plate or the lower end of the pipe, encircles the lower end of the pipe radially outwardly from its opening. A breaking core can be incorporated as a part of the lower end of the pipe or it can be formed as a separate member. The pipe can be used only to feed additional molten metal into the mold as the poured metal starts to solidify or it can be used both to pour the molten metal into the mold cavity and then to provide the additional feed as the metal solidifies.

13 Claims, 4 Drawing Figures

AUXILIARY DEVICE FOR USE WITH A PERMANENT MOLD IN CASTING OPERATIONS

SUMMARY OF THE INVENTION

The present invention is directed to an auxiliary device for use with a permanent mold in casting operations and, more particularly, it is directed to a device which provides a closure for the upper end of the mold cavity during the casting operation.

In the past various devices have been used in permanent mold casting, particularly in the so-called monoblock casting of steel in ingot molds, in order to protect the upper surface of the casting and to insulate it against heat losses or to ensure a sufficient supply of the molten metal so that a pipeless casting or one free of shrink holes is achieved. Exemplary of previous devices is a plate-shaped pressed object of heat insulating or exothermic material which floats on the rising melt surface as the mold is filled, see German Gebrauchsmuster, No. 1,877,593, or a refractory liner insert arranged in the upper part of the mold to receive and influence the melt charging operation, British Pat. No. 565,154. The use of such devices has the disadvantage that the upper surface of the casting is irregular, mostly with occlusions, and requires elaborate reworking, in addition to the separation of the melt charging member. Furthermore, early removal of the casting from the mold is not possible because of the delayed cooling operation. These disadvantages limit the economical production of the castings, especially castings in ingot molds.

The present invention concerns the provision of an auxiliary device for permanent molds which permits the production of castings in quick succession and with a high yield in either top casting or bottom casting with little or no requirement for reworking the top surface of the casting. In particular, the invention concerns the production of molded castings (finished parts) from iron alloys in ingot molds.

In accordance with the present invention, the auxiliary device includes a metal cover plate which bears on the upper surface of the permanent molds and forms the upper limit of the mold cavity. An opening is provided through the upper plate into the mold cavity and at least one pipe formed of a refractory material is inserted downwardly through the opening with its lower end in the plate of the downwardly facing surface of the cover plate. Encircling the lower end of the pipe is an annular recess which is spaced radially outwardly from the opening.

The various features of novelty which characterize the invention are pointed out with particularly in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
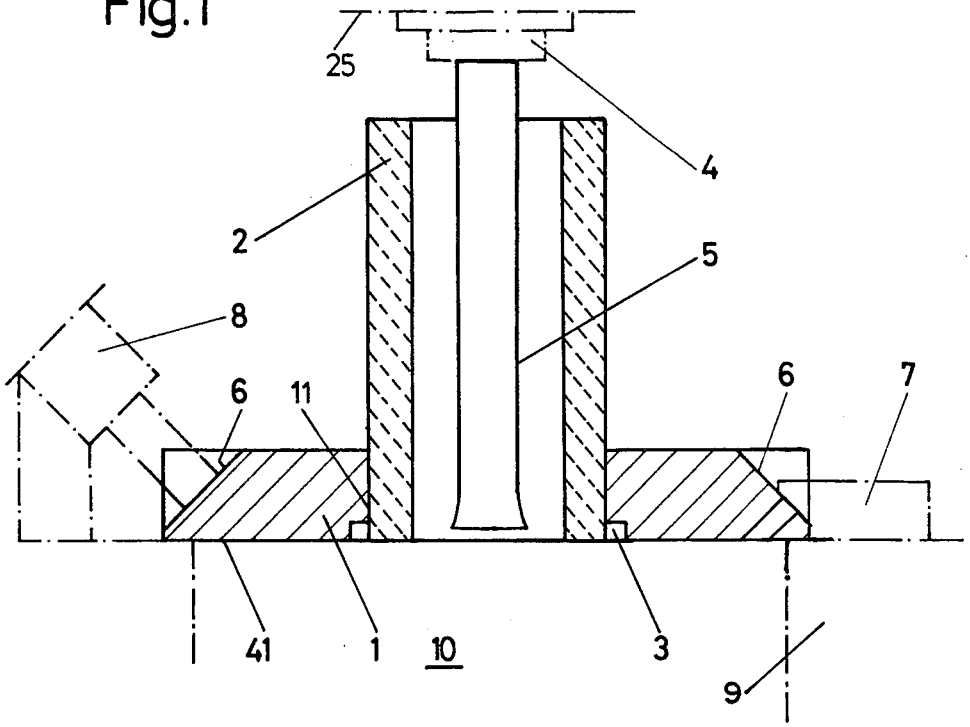
FIG. 1 is a vertical sectional view through an auxiliary device embodying the present invention and it also illustrates, by way of example, apparatus for fastening the device onto a permanent mold.
Figure 2:
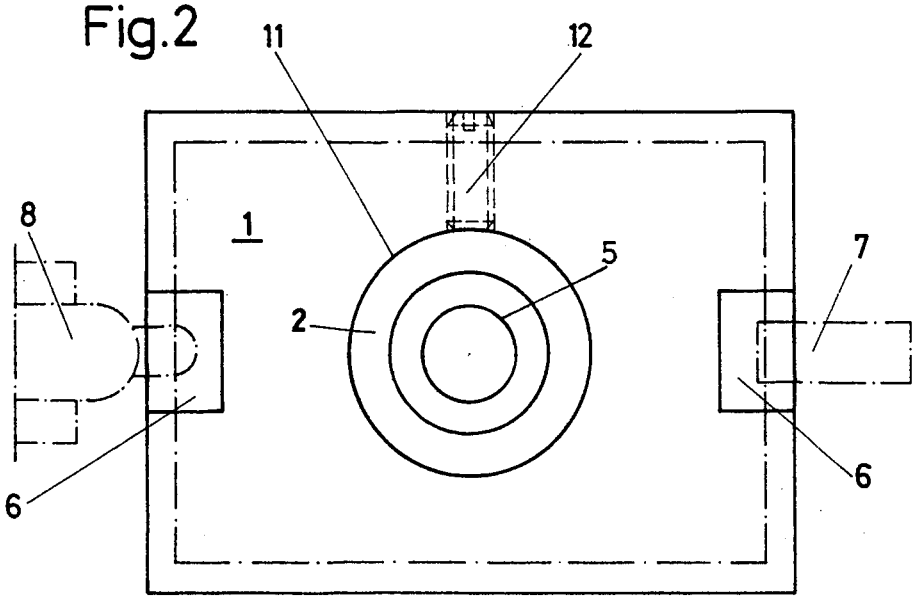
FIG. 2 is a top view of the device displayed in FIG. 1.

In FIGS. 1 and 2 an auxiliary device is illustrated made up of a metal cover plate 1 formed, for example, of cast iron, and a cylindrical pipe 2 formed of refractory material, for example, of fire clay. An opening 11 extends downwardly through the cover plate 1 from its upwardly facing surface to its downwardly facing surface and the lower end of the pipe is flush with the downwardly facing surface of the cover plate. Pipe 2 is detachably mounted in said cover plate 1 by means of a screw 12 extending through the cover plate transversely of the axial direction of the pipe. By threading the screw through the cover plate into contact with the outer surface of the pipe 2, the pipe can be held in place within the openin 11. Encircling the outer surface of the pipe 2, in the downwardly facing surface of the cover plate 1, is an annular recess 3 which, in combination with the radially outer surface of the pipe, forms an annular groove. The recess 3 can have any form and can be located either in the radially outer surface of the pipe 2 or in the downwardly facing surface of the cover plate 1 adjoining the pipe, note FIG. 4.

In FIGS. 1 and 2 a permanent mold 9 is illustrated in phantom lines and consists of a metal ingot mold for molding steel parts with the mold having a cavity 10 into which molten metal is poured. Cover plate 1 has its downwardly facing surface defining the upper limits of the mold cavity 10. The cover plate 1 is removably secured onto the upper end of the mold 9 by means of a controllable cylinder unit 8 and an opposite wedge bolt 7. The two opposite edges of the cover plate contacted by the cylinder unit 8 and the wedge bolt 7 each have a recessed inclined or bevelled surface with which the cylinder unit and the wedge bolt engage. With the cover plate secured in this manner the auxiliary device can withstand the lift of the melt or molten metal poured into the mold cavity 10. With the cover plate secured on the upper surface of the permanent mold 9, as mentioned above, the downwardly facing surface of cover plate 1 forms the upper limit of the mold cavity 10. As can be seen in FIG. 2, the opening into the mold cavity 10 is defined by the phantom line spaced inwardly from the solid black line defining the outer peripheral edge of the cover plate. Accordingly, the cover plate completely covers the open upper end of the mold cavity 10. The opening 11 through the cover plate is centered over the opening into the mold cavity.

For the protection of the inner walls of the pipe 2 during top casting, preferably the melt is introduced through a centrally arranged inner pipe 5 which extends downwardly through the pipe 2 with its lower outlet end coinciding substantially with the downwardly facing surface of cover plate 1. The inner pipe 5 can be secured, for example, to the outlet 4 of a casting vessel 25, shown in phantom lines. In the arrangement shown in FIG. 1, it is possible to fill the molds in a known manner from the bottom, that is, by bottom casting, where the pipe 2 serves only as a feeder member and not as a supply member for charging molten metal into the mold cavity.

Figure 3:
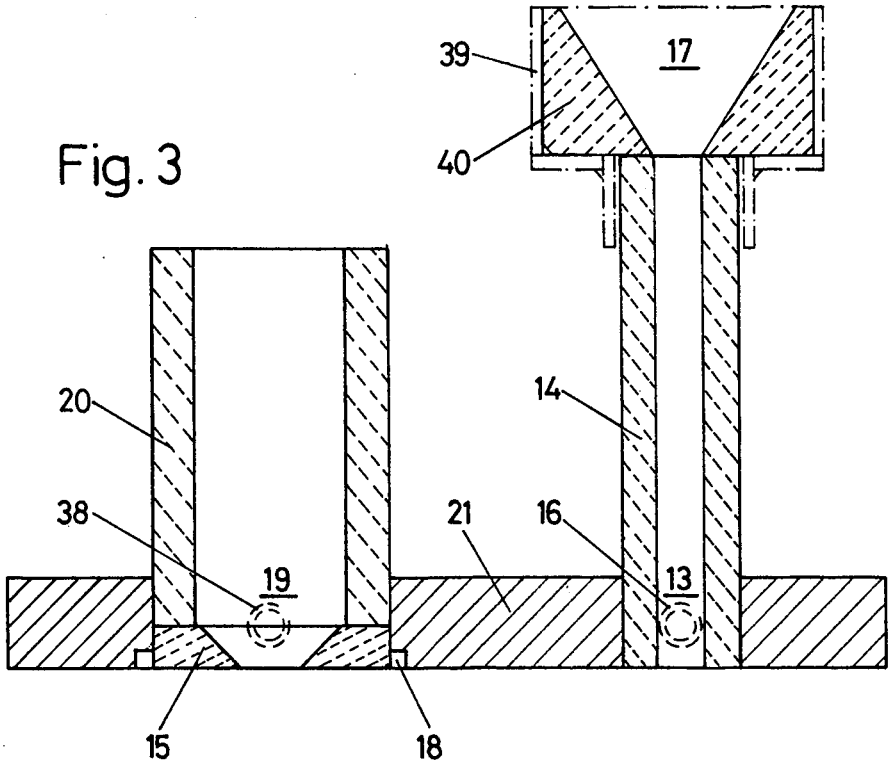
FIG. 3 is a vertical sectional view of another embodiment of the auxiliary device incorporating the present invention and having two pipes passing through the device as compared to the one pipe in FIG. 1.

In FIG. 3, another embodiment of the auxiliary device is shown consisting of a cover plate 21 with openings 13,19 extending through the cover plate from its upwardly facing to its downwardly facing surface. A charging pipe 14 extends through the opening 13 in the cover plate with its lower end disposed in the plane of the downwardly facing surface of the cover plate. The charging pipe 14 serves to supply molten metal into the mold cavity of the permanent mold. Spaced laterally from pipe 14 is another pipe 20 extending through the opening 19 with its lower end flush with the downwardly facing surface of the cover plate 21. Pipe 20 serves to provide a supply of molten metal into the mold as the previously poured metal starts to solidify. For most of its height the pipe 20 is cylindrically shaped, however, at its lower end it forms a breaking core 15 having a frusto-conically shaped surface providing a reduced diameter passage into the mold cavity. The breaking edge between the pipe 20 and the casting is formed at the intersection of the frusto-conically inner surface of the core 15 and the planar downwardly facing surface of the cover plate. The charge pipe 14 and the feed pipe 20 are detachably secured into the openings 13,19 in the cover plate 21 by means of the screws 16,38, respectively. At its upper end, the charge pipe 14 supports a removably detachable funnel 17 which can be reused a number of times and is preferably constructed of a sheet metal housing 39 lined with ceramic material 40. In the lower end of the opening 19 through the cover plate 21 there is an annular recess 18 which forms a shoulder and combines with the outer surface of the breaking core 15 to provide an annular groove encircling the lower end of the pipe 20.

Figure 4:
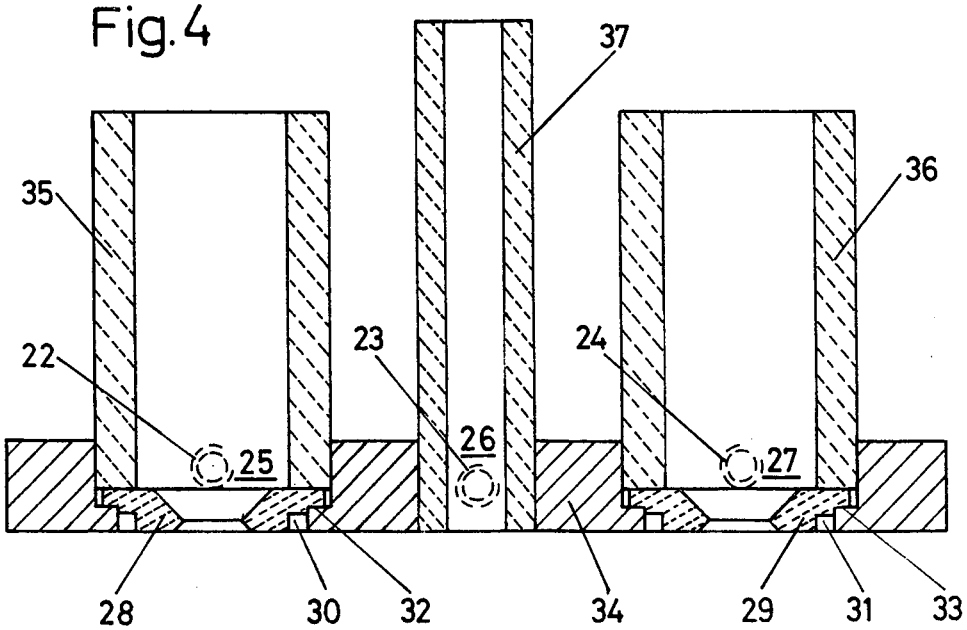
FIG. 4 is a vertical sectional view of still another embodiment of the auxiliary device incorporating the present invention with three pipes included in the device.

In FIG. 4 another variation of the auxiliary device is illustrated and is made up of a cover plate 34 with three pipes extending downwardly through openings in the cover plate. A charge pipe 37 for supplying molten metal into the mold cavity extends downwardly through an opening 26 in the plate and two feed pipes 35,36 each on an opposite side of the charge pipe 37 extend downwardly through openings 25,27. Similar to the auxiliary device shown in FIG. 3, the lower end of the feed pipes 35,36 form breaking cores, however, the breaking cores 28,29 are separate elements which are secured between shoulders 32,33 on the cover plate 34 and the lower ends of the cylindrically shaped feed pipes 35,36. The interior surface of the breaking cores 28,29 which extend downwardly and form a continuation of the passages through the pipes 35,36 are formed of serially arranged frusto-conical surfaces. Each of the breaking cores 28,29 has a pair of serially arranged frusto-conical inner surfaces with the upper frusto-conical surface tapering inwardly and downwardly from the lower end of the pipes 35 and 36 and the lower frusto-conically shaped surface tapering outwardly and terminating in the plane of the downwardly facing surface of the cover plate 34. Each of the breaking cores 28,29 has a recess shoulder 30 in its radially outer surface in the lower end of the core which is flush with the downwardly facing surface of the cover plate. Each of the feed pipes 35,36 and the charge pipe 37 are detachably mounted in the cover plate 34 by means of screws 22,23 and 24, respectively, similar to the screw 12 in FIG. 1.

Each of the feed pipes 2, 20, 35 and 36 in the different embodiments of the auxiliary device illustrated in the drawings, have good insulating or exothermic properties, so that, on the one hand, feeder material retained within the pipe can remain liquid, and on the other hand, replenishing the contents of the feed pipe is possible with a small volume. This arrangement has the effect that no additional heat insulation is required, for example, in the form of a cover at the feed pipe inlets with the result that a relatively high yield, about 95% can be obtained.

In casting molten metal into a permanent mold, the auxiliary device of the present invention operates in the following manner:

After the mold cavity within the permanent mold has been filled and with the melt or molten metal reaching up into the feed pipes, the melt within the mold cavity begins to solidify on the mold walls and on the cover plate with the solidification gradually advancing toward the center of the cross section of the mold cavity. As the melt solidifies, the volume contracts, solidification shrinkage, and at the same time the volume deficit in the still liquid core is compensated by supplying the molten metal from the feed pipe or pipes into the still liquid core inwardly of the solidified portion of the casting. The volumetric contraction of the metal poured into the mold cavity causes a reduction in the outer dimensions of the casting and results in the detachment of the lateral and upper surfaces of the casting from the inner walls of the mold cavity in the permanent mold and also from the cover plate removably secured to the mold. However, the molten core is effectively prevented from flowing out of the feed pipe into the interval between the cover plate and the upper surface of the casting, because a crust or skin connected to the top surface of the casting solidifies in the annular recess 3, 18, 30 and 31 during the early stages following the filling of the mold cavity. The solidification of the metal within the annular recess ensures a seal surrounding the lower end of the feed pipe, despite the fact that vertical shrinkage occurs between the melt charged into the mold cavity and the surface of the mold. The smooth surface formed on the downwardly facing surface of the cover plate and on the surfaces of the permanent mold is preserved on the outer surface of the crust or skin as the casting solidifies.

After a sufficiently thick and hardened "Randschale" (crust/skin) is formed on the casting due to cooling, the attachement of the cover plate to the upper surface of the mold is released and the permanent mold is opened. The casting, along with the auxiliary device, is then gripped with tongs and brought to a point of support. While the casting removed from the mold is fed from the still liquid melt material within the feed pipe or pipes until it is completely solidified, the permanent mold can be prepared with another auxiliary device for another casting. After the casting has completely solidified, the feed pipe and any material it contains can be separated from the casting by means of a hammer. During the removal operation, the cover plate remains intact and can be reused by inserting a new pipe or pipes into its opening or openings.

As a rule, the upper surface of the casting is in good condition and does not require reworking.

The auxiliary device embodying the present invention and used in combination with a permanent mold has the following advantages:

The cover plate effects a closure of the upper end of the mold cavity within the permanent mold and, at the same time, incorporates the pipe or pipes for charging the melt into the mold cavity and for replenishing the melt during volumetric contraction as the casting shrinks during solidification.

The cover plate can be used repeatedly.

Improved utilization of the permanent mold can be achieved, since the casting can be removed from the mold when its outer skin has solidified.

The service life of the mold is increased because of the smaller temperature fluctuations involved due to earlier removal of the casting from the mold.

Replenishing of the melt through the feed pipes is possible from the exterior of the mold.

The casting jet used in charging the melt into the mold cavity can be directed through the charge pipe in the cover plate so that the interior surfaces of the mold are optimally protected.

The cover plate can be economically produced in a casting operation.

The solidified material connected to the casting through the breaking core can be removed in a simple manner, for example, by means of a hammer.

A high yield, about 95%, can be achieved with the auxiliary device.

The use of the auxiliary device permits the upper surface of the casting to be cooled while keeping the melt material within the feed pipe liquid for a sufficiently long period of time so that the material can continue to afford a supply of melt to the liquid core within the casting.

While specific emmbodiments of the invention have been shown and described in detail to illustrate the application of the inventive principles, it will be understood that the invention may be embodied otherwise without departing from such principles.

What is claimed is:

1. An auxiliary device for use with a permanent mold in a casting operation comprising a metallic cover plate having an upwardly facing surface and an oppositely directed downwardly facing surface with the downwardly facing surface arranged to bear on the top of the permanent mold and to form the upper limit of the mold cavity within the permanent mold, a first opening through said cover plate extending between the upwardly and downwardly facing surfaces and said first opening arranged to open into the mold cavity, a first pipe formed of a refractory material extending downwardly into the first opening in said cover plate, said first pipe having a lower end located substantially in the plane of the downwardly facing surface of said cover plate, and an annular recess encircling and spaced radially outwardly from the opening in the lower end of said first pipe and said recess located in at least one of the adjoining surfaces of the downwardly facing surface of said cover plate and the lower end of said first pipe and open to the mold cavity, said recess being closed inwardly of the opening therefrom into the mold cavity so that molten metal overflowing into the recess from the mold cavity is retained therein and solidifies forming a seal, said first pipe adapted for feeding molten metal into the liquid core in the casting after the completion of the pouring operation as the molten metal within the mold cavity commences to solidify.

2. An auxiliary device, as set forth in claim 1, wherein said annular recess is formed in said cover plate and extends around the first opening therethrough with the radially outer surface of said first pipe limiting the radially inner surface of said annular recess.

3. An auxiliary device, as set forth in claim 1, wherein a charge pipe is located within and spaced radially inwardly from said first pipe, said charge pipe extends downwardly within said first pipe and has its lower end in substantially the same plane as the downwardly facing surface of said cover plate with said charge pipe serving to pour molten metal into the mold cavity and said first pipe serving to feed molten metal into the liquid core in the casting after the pouring operation has been completed and the molten metal commences to solidify.

4. An auxiliary device, as set forth in claim 1, wherein a second opening extends through said cover plate in laterally spaced relation to said first opening between the upwardly and downwardly facing surfaces, and a second pipe extending downwardly into the second opening in said cover plate and having its lower end located substantially in the plane of the downwardly facing surface of said cover plate with said second pipe serving to pour molten metal into the mold cavity in the permanent mold and said first pipe serving to feed molten metal into the liquid core in the casting within the mold cavity after the pouring operation has been completed and the molten metal in the mold cavity commences to solidify.

5. An auxiliary device, as set forth in claim 4, wherein a funnel is detachably mounted on the upper end of said second pipe.

6. An auxiliary device, as set forth in claim 1, wherein said cover plate has bevelled surfaces in the upwardly facing surface thereof along two opposite sides, and means arranged to be mounted on the top of the permanent mold for engagement with said bevelled surfaces for releasably securing the auxiliary device to the permanent mold.

7. An auxiliary device, as set forth in claim 1, wherein a screw is secured in threaded engagement with said cover plate and extends transversely of the axial direction of said pipe and into the first opening in said cover plate so that said screw can detachably secure said first pipe to said cover plate.

8. An auxiliary device, as set forth in claim 1, wherein the lower end of said first pipe is formed as a breaking core.

9. An auxiliary device, as set forth in claim 8, wherein said first pipe has a circular shaped inner surface and said breaking core at the lower end of said first pipe has a frusto-conical shape tapering inwardly from the circular shaped inner surface of said first pipe to the lower end of said first pipe formed by said breaking core.

10. An auxiliary device, as set forth in claim 1, wherein the lower end of said first pipe includes a separate breaking core with the downwardly facing surface of said breaking core being located in the plane of the donwardly facing surface of said cover plate and said separate breaking core forming a continuation of the opening through said first pipe.

11. An auxiliary device, as set forth in claim 10, wherein said first opening in said cover plate has a radially outwardly stepped surface extending upwardly from the downwardly facing surface of said cover plate and said stepped surface forming an upwardly facing shoulder, the radially outer surface of said separate breaking core being stepped and forming a downwardly facing surface which is supported on said upwardly facing shoulder on said cover plate, and the lower end of said first pipe disposed in bearing contact with the upper end of said separate breaking core so that said breaking core is held between said first pipe and said cover plate.

12. An auxiliary device, as set forth in claim 10, wherein said annular recess is formed in the radially outer surface of the downwardly facing surface of said separate breaking core with the inner surface of the first opening through said cover plate limiting the radially outer surface of said annular recess.

13. An auxiliary device, as set forth in claim 10, wherein said first pipe has a circular shaped inner surface, said separate breaking core has a downwrdly facing surface in the plane of the downwardly facing surface of said cover plate and an upwardly facing surface in contact with the lower end of said first pipe, the radially inner surface of said breaking core comprises a first frusto-conical surface tapering inwardly in the downward direction from the upwardly facing surface thereof and a second frusto-conical surface extending downwardly from the lower end of said first frusto-conical surface and tapering outwardly from the lower end of said first frusto-conical surface to the plane of the downwardly facing surface of said separate breaking core, and the upper end of said first frusto-conical surface having a smaller diameter than that of the circular shaped inner surface of said first pipe.

* * * * *